US005331910A

United States Patent [19]

Mukai et al.

[11] Patent Number: 5,331,910

[45] Date of Patent: Jul. 26, 1994

[54] SEWING MACHINE WITH AUXILIARY TRANSPORT ROLLERS, BELT, AND CUTTER

[75] Inventors: Hirochika Mukai; Tomoyuki Nakajo, both of Osaka, Japan

[73] Assignee: Pegasus Sewing Maching Mfg. Co., Ltd., Osaka, Japan

[21] Appl. No.: 5,654

[22] Filed: Jan. 19, 1993

[30] Foreign Application Priority Data

Jun. 24, 1992 [JP] Japan ..... 4-165622

[51] Int. Cl.[5] ..... D05B 27/12; D05B 35/06; D05B 37/06

[52] U.S. Cl. ..... 112/121.26; 112/129; 112/322; 83/902

[58] Field of Search ..... 112/121.26, 121.27, 112/152, 104, 285, 288, 291, 293, 294, 299, 303, 307, 318, 320, 322, 130; 83/175, 436, 606, 902, 917

[56] References Cited

U.S. PATENT DOCUMENTS

| | | | |
|---|---|---|---|
| 1,060,799 | 5/1913 | Van Horn | 112/303 |
| 2,199,270 | 4/1940 | Roselius et al. | 112/322 X |
| 2,378,730 | 6/1945 | Seaman | 112/322 |
| 2,907,291 | 10/1959 | Schrader | 112/318 |
| 3,886,878 | 6/1975 | Block | 112/322 X |
| 4,441,438 | 4/1984 | Takahashi | 112/322 X |
| 4,594,955 | 6/1986 | Lichtenberg | 112/129 X |
| 4,813,364 | 3/1989 | Boser | 112/304 |
| 5,159,889 | 11/1992 | Price et al. | 112/228 X |

FOREIGN PATENT DOCUMENTS

| | | | |
|---|---|---|---|
| 2049888 | 3/1987 | Japan | 112/303 |
| 0745233 | 2/1956 | United Kingdom | 112/129 |

*Primary Examiner*—Clifford D. Crowder
*Assistant Examiner*—Ismael Izaguirre
*Attorney, Agent, or Firm*—Flynn, Thiel, Boutell & Tanis

[57] ABSTRACT

An auxiliary transport device for sending out workpieces sewn on an elastic tape by a sewing machine is composed of front and rear rollers and a belt transmission device, and a cutter between the rollers, and one of the rollers is rotated and driven in synchronism with the sewing machine. A belt of the belt transmission device transmits the rotation of one roller to the other roller and works to transport the workpieces while pressing and flattening them on the cloth feed surface, and prevents the end of workpieces from curling up due to shrinkage of the tape when the tape is cut, thereby leading the end smoothly to the rear roller.

3 Claims, 3 Drawing Sheets

SEWING MACHINE WITH AUXILIARY TRANSPORT ROLLERS, BELT, AND CUTTER

FIELD OF THE INVENTION

The present invention relates to a sewing machine used for sewing an elastic tape to the waist portion of panties, the opening portions for legs of briefs and shorts, or the like.

DESCRIPTION OF THE PRIOR ART

As a sewing machine for continuously sewing a tape to the workpieces for garments, hitherto, the transport device disclosed, for example, in the U.S. Pat. No. 4,290,376 has been used.

This apparatus comprises a sewing machine for feeding and sewing a tape to workpieces passed beneath a presser foot of the sewing machine, an auxiliary transport device disposed on delivery side of the presser foot and possessing a front roller and rear rollers for sending out the sewn workpieces by engaging with them, and a tape cutting device disposed between the front and rear rollers. The workpieces are sewn on the tape in sequence while feeding a long tape successively and workpieces in short intervals beneath the presser foot, and the tape between the preceding workpiece and succeeding workpiece sent out from the presser foot by the auxiliary transport device is stretched to a taut state, and cut off by the tape cutting device right after sewing. In this apparatus, since the tape is cut off in a taut state between the workpieces as mentioned above, the rear end of the preceding workpiece and the front end of the succeeding workpiece are attracted to the front and rear roller respectively together with the cut ends of the tape due to shrinkage of the tape right after being cut off. The rear end of the preceding workpiece attracted to the rear roller is smoothly sent out by the rear roller, while the front end of the succeeding workpiece attracted to the front roller is apt to wind around the front roller due to the rotation of it, and can not be smoothed out to transport the succeeding workpiece to the rear roller. Such a tendency was particularly notable in a knitted fabric or other curly materials.

SUMMARY OF THE INVENTION

It is hence an object of the invention to present a sewing machine with an auxiliary transport device for sending out sewn workpieces and cutting a tape between workpieces which are continuously sewn on the tape one after another. Another object of the invention is to present a transport device capable of enhancing the sewing efficiency by smoothly transporting the front end of the workpiece after cutting the tape in a simple structure.

In the sewing machine of the invention, the auxiliary transport device for sending out the workpiece has a front roller and a rear roller at the delivery side of a presser foot of the sewing machine. One roller of the front and rear rollers is rotated and driven in synchronism with the driving of the sewing machine, while the other roller is rotated and driven by said one roller through belt transmission means. A belt of the belt transmission means is caused to run along near the sewing line and pressed tightly to a delivery surface of the sewing machine.

According to the sewing machine of the invention, the belt driven in synchronism with the sewing machine presses and transports the workpieces, which are sewn and linked at a specific interval on the tape, against the delivery surface while maintaining the interval, and curling at the ends of the workpieces due to shrinkage of the tape is prevented when the tape is cut off between the front and rear rollers, so that the front end of the succeeding workpiece may be smoothly led to the rear roller.

The curling phenomenon of the end of workpiece at the cutting tape is similarly found when sewing the tape to a curly fabric such as a knitted fabric, aside from the effect due to shrinkage of the tape. Therefore, the invention may be similarly applied when sewing various tapes to curly fabrics, in addition to the case of sewing the elastic tape.

The belt is desired to be a toothed belt and engage with gear wheels coaxial with the front and rear rollers for secure the transport action.

The rollers of the auxiliary transport device should be preferably made of a material having a high coefficient of friction or a rough surface so that the workpiece may be fed securely without slippage, and multiple grooves parallel to the axial direction of the roller should be formed on the circumferential surface.

In the apparatus of the invention, for feeding the tape beneath the presser foot for sewing the tape, in order to guide the tape and to feed it in securely, it is preferred to install guide means, such as a tubular guide for guiding the tape before the presser foot, a pair of rollers for feeding and applying a tension to the tape, with at least one roller acting as drive roller, and other tape supply devices.

DESCRIPTION OF THE PREFERRED EMBODIMENT

Figure 1:
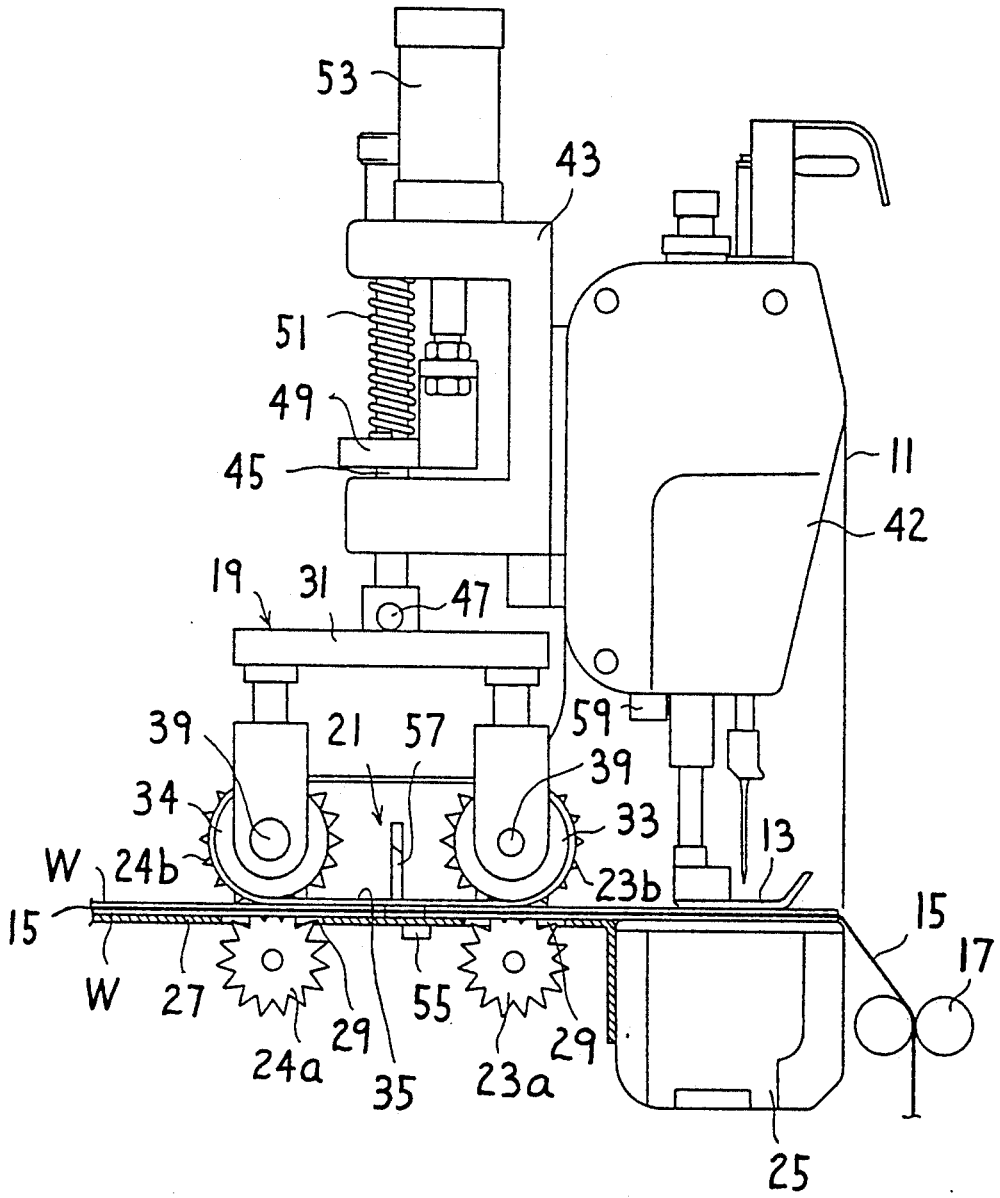
FIG. 1 is a fragmentary side view of a sewing machine of the invention.

As shown in FIG. 1, in front of a presser foot 13 of a twin needle covering chain stitch sewing machine 11, a tape feed roller 17 is provided for removing an elastic tape 15 from a reel not shown, and sending it beneath the presser foot while applying a constant tension to the tape. At the delivery side of the presser foot 13, an auxiliary transport device 19 is disposed for engaging with the workpiece to which the elastic tape has been sewn and transporting the elastic tape in stretched state. A tape cutting device 21 is disposed between a front roller **23*b* and rear roller 24*b* of the auxiliary transport device 19 for cutting the elastic tape 15. Beneath the presser foot 13**, a feed dog is disposed, but it is not shown in the drawing.

The front and rear rollers of the auxiliary transport device 19 comprise respectively lower rollers **23*a*, 24*a* and upper rollers 23*b*, 24*b* having multiple V-grooves in the circumferential direction respectively, and the lower rollers 23*a*, 24*a* are rotatably pivoted under a table 27 which is to be a delivery surface of the sewing machine 11 and mounted on the back side of a sewing machine bed 25 flush with the sewing machine bed 25, and parts of the lower rollers 23a, 24a project from openings 29 formed in the table 27**.

The upper rollers 23b, 24b for transporting the workpiece in collaboration with the lower rollers 23a, 24a are rotatably mounted on a bifurcated double holder 31, and flanged gear wheels 33, 34 having nearly the same outside diameter as the rollers 23b, 24b are attached to one side thereof. An endless toothed belt 35 is applied on the front and rear flanged gear wheels 33, 34. The toothed belt 35 is pressed against the table 27 on the outer circumference of the lower side along near the sewing line at the same position as the stitch S shown in FIG. 3, and is rotated intermittently in synchronism with the cloth feed of the sewing machine 11 by a drive mechanism mentioned below.

The toothed belt 35 serve the function of transmitting the motion of the front upper roller 23b, which is closer to the sewing machine, to the rear upper roller 24b to rotate the roller intermittently, a flattening function by pressing the workpiece on the table 27, and a function of transporting the workpiece pressed on the table by its own intermittent rotation.

The drive mechanism for intermittently rotating the upper roller 23b comprises an oscillating shaft 37 for oscillating, which is interlocked with the main shaft (not shown) of the sewing machine, a crank lever mechanism 41 for coupling a roller shaft 39, which is rotatably pivoted on the bifurcated double holder 31, and the oscillating shaft 37 to transmit the motion of the oscillating shaft 37 to the roller shaft 39, thereby oscillating the roller shaft 39, and a known one-way clutch (not shown) incorporated in the roller 23b for intermittently rotating the upper roller 23b only when the roller shaft 39 rotates in the clockwise direction in FIG. 1. A step motor may be used instead of the above drive mechanism, and the upper roller 23b may be rotated intermittently by the motor.

The bifurcated double holder 31 for rotatably pivoting the upper rollers 23b, 24b is rotatably borne by a horizontal pin 47 at the lower end of a vertical shaft 45, which is elevatably supported on a bracket 43 attached to the back side on a head 42 of the sewing machine 11. The bifurcated double holder 31 is usually pushed down by the action of a coil spring 51 wound on the vertical shaft 45 between the bracket 43 and a spring retainer 49 affixed to the vertical shaft 45, and the upper rollers 23b, 24b are pressed against the lower rollers 23a, 24a, while the belt 35 is pressed against the table 27.

On the bracket 43, an air cylinder 53 is attached and coupled with the spring retainer 49. The air cylinder 53 is usually in an inactive state, and therefore the upper rollers 23b, 24b and the toothed belt 35 are always pushed down by the action of the spring 51, but it becomes active when necessary, for example, during the removal of the workpiece from the device, and the vertical shaft 45 is lifted up against the action of the spring 51, so that the upper rollers 23b, 24b and the toothed belt 35 are lifted above the table.

The tape cutting device 21 is disposed between the front rollers 23a, 23b and the rear rollers 24a, 24b consists of a lower knife 55 attached to the table 27 and possessing a cutting edge in a direction orthogonal to the cloth feed direction, and an upper knife 57 rotatably borne vertically above the lower knife for cutting the elastic tape 15 in collaboration with the lower knife 55 upon being pushed down by the action of an air cylinder 56. A cloth sensor 59 is attached on the head 42 and detects the clearance between the preceding workpiece and succeeding workpiece sewn on the tape. The action of the air cylinder 56 for pushing down the upper knife 57 is effected on an order from a control unit (not shown) which counts the number of stitches of the sewing machine after detecting the clearance by the cloth sensor 59. That is, when the clearance between the workpieces passes beneath the cloth sensor 59 and the sensor 59 detects it, a signal is sent to the control unit of the sewing machine, and the control unit counts the number of stitches after receiving the signal, and when reaching the specific number of stitches, the air cylinder is actuated, and the upper knife 57 is lowered to cut the tape between workpieces.

Figure 4:
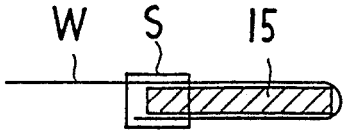
FIG. 4 is a partial sectional view of a workpiece to which a tape is sewn.
Figure 2:
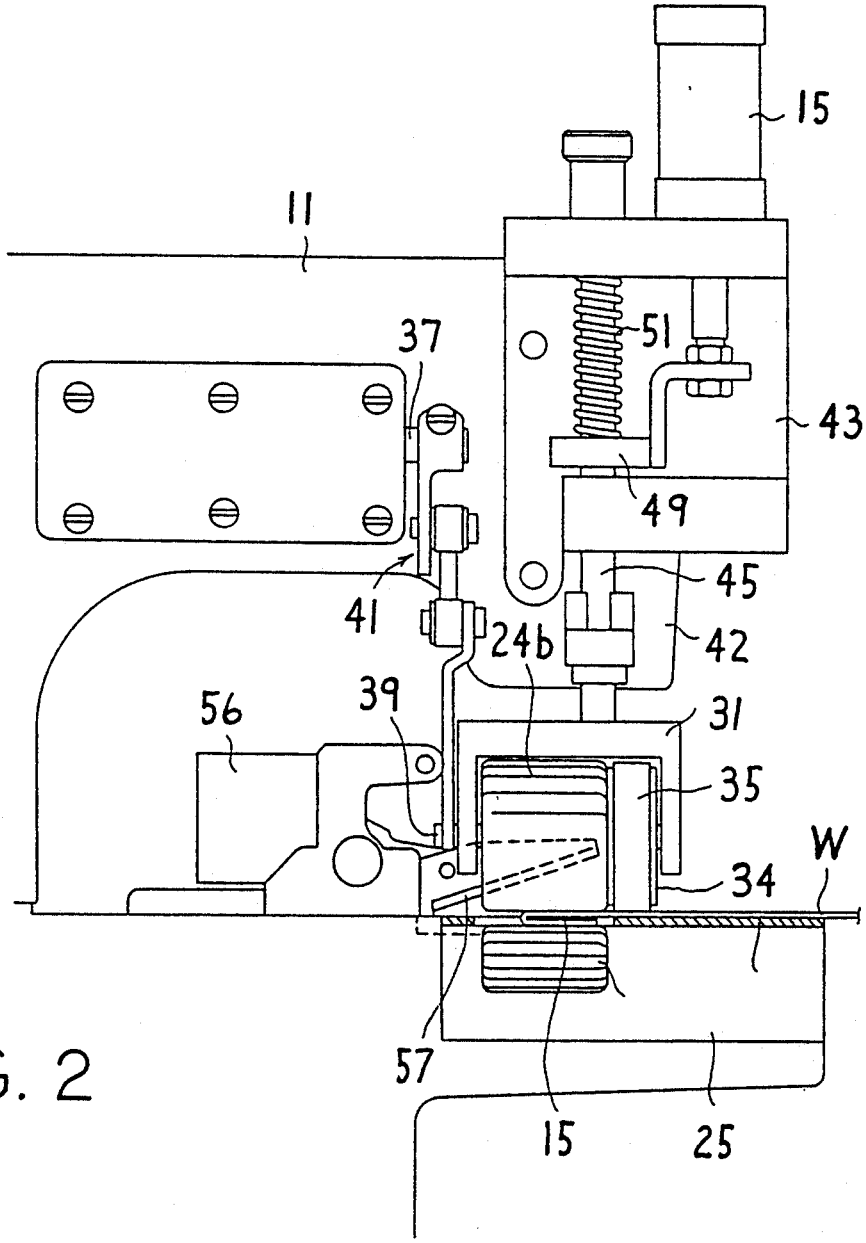
FIG. 2 is a fragmentary rear view of the sewing machine shown in FIG. 1.

The operation of the abovementioned apparatus is explained below for a workpiece W as shown in FIG. 4, in the sequence of folding back an edge of workpiece W downward, inserting the elastic tape 15 into the vertically plaited portion of the edge, sewing the workpiece on the elastic tape, and cutting the elastic tape.

First, with the presser foot 13 and upper rollers 23b, 24b lifted up, the elastic tape 15 let off from the reel is passed into the tape feed roller 17, and is led in between the upper and lower rollers 23a, 23b, 24a, 24b through the lower part of the presser foot 13, and then the presser foot 13 and upper feed rollers 23b, 24b are lowered.

In succession, by means of a known cloth guide disposed before the presser foot 13, the edge of the workpiece W1 is folded back downward, and the front end of the workpiece W1 is led beneath the presser foot so as to envelope the elastic tape 15, and the sewing machine 11 is started up.

Figure 3:
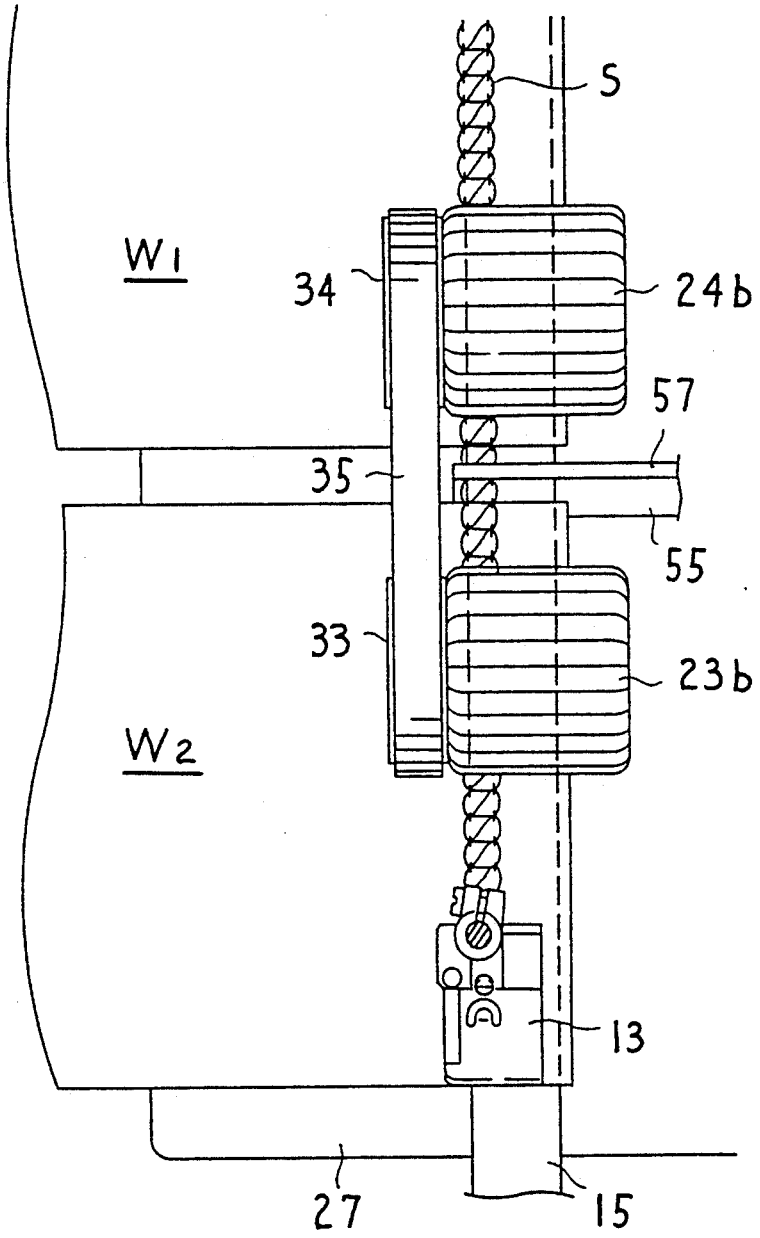
FIG. 3 is a fragmentary plan view of an auxiliary transport device and a cutting device disposed behind a presser foot of the sewing machine.

Since the peripheral speed of the tape feed roller 17 is preliminarily set lower than the feed speed of the sewing machine 11, as the sewing machine 11 starts up, the elastic tape 15 is sewn to the workpiece W1 in a stretched state. After the tape 15 is sewn to the workpiece W1, successively, the next workpiece W2 is similarly led to beneath the presser foot 13, and sewing is continued, and the workpiece W1 and workpiece W2 are linked together with the elastic tape 15 as shown in FIG. 3, and are sent out in this state by the rollers 23a, 23b, 24a, 24b. When the rear end of the workpiece W1 passes beneath the sensor 59, and the absence of workpiece is detected by the sensor 59, its output signal is sent to the control unit of the sewing machine, and the counting of the number of stitches is started. Upon reaching the specific number of stitches, when the elastic tape 15 between the workpieces W1 and W2 reaches the cutting position of the tape cutting device 21, the air cylinder 56 is actuated by the control signal from the control unit, and the upper knife 57 is lowered, and cooperates with the lower knife 55 to cut the elastic tape 15.

Simultaneously with the cutting, the rear end of the workpiece W1 and the front end of the workpiece W2 are attracted to respective near rollers 23b, 24b by the shrinkage of the elastic tape 15, but since the belt 35 is applied between both rollers close to the stitch S and pushes and flattening the workpiece W1 and workpiece W2 on the table 27, they are smoothly sent out without winding on the rollers, and the front end of the workpiece W2 is also lead in a flat state to the rear rollers 24a, 24b, moving on the table 27, by the belt 35.

What is claimed is:

1. A sewing machine with an auxiliary transport device for transporting and cutting a tape to be sewn on a plurality of workpieces, said auxiliary transport device comprising:

a tape feed device provided at a feed side of a presser foot of the sewing machine, said tape feed device comprising a pair of rollers for feeding the tape at a lower speed than the sewing speed of the sewing machine so that a tension is applied to the tape;

a front roller and a rear roller provided at a delivery side of the presser foot for engaging with and transporting sewn workpieces, said front and rear rollers being rotated and driven in synchronism with the driving of the sewing machine with one of said front and rear rollers driving the other of said front and rear rollers through a belt transmission device, a belt of said belt transmission device being disposed near a sewing line of the sewing machine and pressed against a delivery surface of the sewing machine; and a tape cutting device provided between the front and rear rollers for cutting the tape between the workpieces.

2. A sewing machine of claim 1, wherein the belt of the belt transmission device is a toothed belt and is applied in engagement with flanged gear wheels which are coaxial with the front and rear rollers respectively.

3. A sewing machine of claim 1, wherein the front and rear rollers are supported at branched ends of a bifurcated holder which is rotatably supported by a horizontal pin at the lower end of a vertical shaft which is thrust downward by a spring.

* * * * *

UNITED STATES PATENT AND TRADEMARK OFFICE

CERTIFICATE OF CORRECTION

PATENT NO. : 5 331 910

DATED : July 26, 1994

INVENTOR(S) : Hirochika MUKAI, et al

It is certified that error appears in the above-indentified patent and that said Letters Patent is hereby corrected as shown below:

On the title page, item [73] change the name of assignee; "Pegasus Sewing Maching Mfg. Co., Ltd.," to ---Pegasus Sewing Machine Mfg. Co., Ltd.,---.

Signed and Sealed this

Eleventh Day of October, 1994

*Attest:*

Bruce Lehman

BRUCE LEHMAN

*Attesting Officer*

*Commissioner of Patents and Trademarks*